US006145968A

United States Patent [19]

Fries et al.

[11] Patent Number: 6,145,968

[45] Date of Patent: Nov. 14, 2000

[54] SYSTEM AND METHOD FOR SUPPLYING INK TO A PRINTER

[75] Inventors: William Fries, San Diego; Timothy J. Morrison, Oceanside; Steven J. Wirth, Escondido, all of Calif.

[73] Assignee: Encad, Inc., San Diego, Calif.

[21] Appl. No.: 09/036,103

[22] Filed: Mar. 6, 1998

Related U.S. Application Data

[60] Provisional application No. 60/036,547, Mar. 7, 1997, and provisional application No. 60/040,733, Mar. 12, 1997.

[51] Int. Cl.[7] ..... B41J 2/175

[52] U.S. Cl. ..... 347/85

[58] Field of Search ..... 347/85, 86, 87

[56] References Cited

U.S. PATENT DOCUMENTS

| | | | |
|---|---|---|---|
| 3,967,286 | 6/1976 | Andersson et al. | 347/87 |
| 4,074,284 | 2/1978 | Dexter et al. | 347/49 |
| 4,126,868 | 11/1978 | Kimer | 347/92 |
| 4,178,595 | 12/1979 | Jinnai et al. | 347/7 |
| 4,187,511 | 2/1980 | Robinson | 347/7 |
| 4,383,263 | 5/1983 | Ozawa et al. | 347/30 |
| 4,403,233 | 9/1983 | Terasawa et al. | 347/30 |
| 4,513,297 | 4/1985 | Okamura | 347/85 |
| 4,527,175 | 7/1985 | Kojima et al. | 347/85 |
| 4,558,326 | 12/1985 | Kimura et al. | 347/30 |
| 4,593,294 | 6/1986 | Parisi | 347/49 |
| 4,639,738 | 1/1987 | Young et al. | 347/89 |
| 4,677,448 | 6/1987 | Mizusawa et al. | 347/85 |
| 4,757,331 | 7/1988 | Mizusawa | 347/85 |
| 4,831,389 | 5/1989 | Chan | 347/86 |
| 4,926,196 | 5/1990 | Mizoguchi et al. | 347/23 |
| 4,967,207 | 10/1990 | Ruder | 347/87 |
| 4,968,998 | 11/1990 | Allen | 347/7 |
| 5,159,348 | 10/1992 | Dietl et al. | 347/89 |
| 5,189,438 | 2/1993 | Hine et al. | 347/89 |
| 5,311,214 | 5/1994 | Hirasawa et al. | 347/6 |
| 5,367,328 | 11/1994 | Erickson | 347/7 |
| 5,877,795 | 3/1999 | Gragg et al. | 347/92 |

FOREIGN PATENT DOCUMENTS 361063455 4/1986 Japan .

*Primary Examiner*—N. Le
*Assistant Examiner*—Anh T. N. Vo
*Attorney, Agent, or Firm*—Knobbe, Martens, Olson & Bear, LLP

[57] ABSTRACT

An inkjet printer uses large volume ink reservoir containers to supply ink to ink cartridges located on a movable print carriage. A communication link including tubing sections and quick disconnect fittings couples the large volume ink reservoir containers and the ink cartridges. The printer may be plumbed with more ink supply tubing sections than ink cartridges and ink reservoirs for the provision of different ink types. The changing of sets of large volume ink reservoir containers or sets of ink cartridges is more convenient with the use of quick disconnect fittings.

10 Claims, 5 Drawing Sheets

SYSTEM AND METHOD FOR SUPPLYING INK TO A PRINTER

PRIORITY CLAIM

This application claims the benefit under 35 U.S.C. § 119(e) of U.S. Provisional Application Ser. No. 60/036,547 filed Mar. 7, 1997, entitled "A Multi-Plumbed Ink Supply System for an Ink Jet Printer" and U.S. Provisional Application Ser. No. 60/040,733 filed Mar. 12, 1997, entitled "Ink Supply and Priming System for an Ink Jet Printer".

BACKGROUND

Contemporary disposable ink cartridges typically include a self-contained ink reservoir, a jet plate assembly supporting a plurality of inkjet nozzles in combination with the ink reservoir, and a plurality of external electrical contacts for connecting the inkjet nozzles to driver circuitry. Typically, without regard to whether or not the jet plate assembly remains fully functional, the entire ink cartridge must be disposed of when the ink in the cartridge ink reservoir is completely depleted.

For thermal inkjet printer cartridges, failure is usually caused by the failure of the resistors used to heat the ink in proximity to each nozzle. However, because the resistors have such low failure rates, the typical jet plate assemblies used in disposable ink cartridges are fully operable to within their original print quality specifications even after their original ink reservoirs have been completely depleted. Thus, the contemporary disposable cartridge represents a considerable waste of product resulting in higher costs to the consumer both in product cost and the time lost in frequently replacing depleted ink cartridges.

Manually refilling the ink reservoir inside the disposable ink cartridge is a feasible option for continuing to use the cartridge as long as the print quality from the jet plate is known to be high. However, this process is messy and difficult because many disposable ink cartridges are not designed with refilling in mind. More recently, some ink cartridges have been designed to enable manual replenishment. However, this still does not mitigate the inconvenience, time, and expense involved in having to refill the ink cartridge reservoir frequently.

Automatic refilling has also been contemplated. Systems have been proposed which allow periodic refilling of the ink-jet cartridge at a "service station" provided at one extreme of print carriage movement. In addition, various schemes of continuously supplying ink to the small reservoir in the disposable inkjet cartridge from a larger reservoir located remote from the print carriage have been created. In many of these systems, the external ink reservoir, the ink cartridge, and the tubing connecting the external reservoir to the ink cartridge are configured to form a unitary single piece replaceable assembly. The volume of ink in the external reservoir is designed to be depleted when the print quality of the jet plate on the ink cartridge assembly has degraded to a level that may provide unsatisfactory printing results.

Systems such as these also have several disadvantages. They require the disposal of a large ink reservoir, an ink cartridge, and the tubing connecting the two once the ink in the large reservoir has been depleted. The waste and initial cost to the consumer therefore still exists for this type of system. In the graphic arts industry, it has also become common to use different types of inks for different applications, such as indoor and outdoor applications. With existing systems, it is very inconvenient to re-plumb a printer with new reservoirs, cartridges, and associated connecting tubing when a different ink type is required for a new print job.

SUMMARY OF THE INVENTION

The present invention includes a system and method for supplying ink to a printer. In one embodiment, a multi-plumbed ink supply system for providing a continuous volume of ink to ink cartridges in an printer is provided. The multi-plumbed ink supply comprises a plurality of ink reservoir containers, an ink reservoir container mounting assembly, a plurality of tubing sections, a print carriage, and a plurality of ink cartridges mounted on a print carriage.

In another embodiment, the printer may be double-plumbed for printing applications requiring two sets of ink, or multi-plumbed for high color resolution printing using two or three valved coupling devices. In some embodiments, for example, in double-plumbed ink supply systems, a first set of ink reservoir containers uses a first set of valved coupling devices and tubing sections provided by the printer. If a second set of ink reservoir containers is preferred for a printing application, the first set of ink reservoir containers is disconnected and removed. Then, a second set of ink reservoir containers is removably mounted and connected using a second set of valved coupling devices and tubing sections provided by the printer. Similarly, two sets of ink cartridges could be used. If a first set of ink reservoir containers is connected and removably mounted, then a first set of ink cartridges is connected with its own first set of valved coupling devices and tubing sections. If a second set of ink reservoir containers is connected and removably mounted, then a second set of ink cartridges is connected with its own second set of valved coupling devices and tubing sections. However, another embodiment employs only one set of ink cartridges and connects that set of ink cartridges to the appropriate set of tubing sections depending upon which set of ink reservoir containers is being used.

In one embodiment, the flow of ink through the valves and connected tubing sections is enabled only when the valved coupling fittings located at the ends of tubing sections are mated, thereby preventing unwanted ink flow. Further, the connection and disconnection of valved coupling fittings is easy and quick. Accordingly, both the ink cartridges and the ink reservoir containers which use valved coupling fitting assemblies are connected or removed quickly, conveniently, and with little unwanted ink escaping.

The supply system operates by supplying ink from ink reservoir containers to ink cartridges. In one embodiment, a fluid communication link uses siphoning action in order supply ink from ink reservoir containers to ink cartridges. The supply of ink from ink reservoirs containers has the advantage of disposing of ink cartridges only when the inkjet plate assembly degrades below certain high quality printing specifications. Further, because the ink cartridges are continuously supplied ink from a remote location, the ink cartridges are light weight and maintain a relatively constant weight. Thus, the ink cartridges do not burden the print carriage drive motor and the compensation for imbalanced time-varying loading becomes minimal. In addition, the filling of the much larger volume ink reservoir containers is less frequent, much easier, and more tidy than the filling up an ink reservoir in an ink cartridge.

In one embodiment, each ink reservoir container contains a plurality of chambers with each chamber having its own ink reservoir. Each ink cartridge has multiple chambers with each chamber having its own jet plate. Each jet plate is coupled through a fluid communication link with an ink reservoir located in one chamber of one ink reservoir container.

In another embodiment, each chamber of each ink reservoir container has a quick connect fitting assembly. The quick connect fitting assembly allows for the quick and clean connection and disconnection of ink reservoir containers from the fluid communication links. Further, quick connect fitting assembly also allows for the replacement of only those components, such as, for example, a damaged ink reservoir container, that need to be replaced.

In still another embodiment, each jet plate assembly of each ink cartridge has a quick connect fitting assembly. The quick connect fitting assembly allows for the quick and clean connection and disconnection of ink reservoir containers from the fluid communication links.

In one embodiment, a priming system using a quick connect fitting assembly may be applied when the priming of the communication links or of the jet plate assemblies may be required.

DETAILED DESCRIPTION OF THE PREFERRED EMBODIMENT

An ink supply system having a valved and multi-plumbed design is provided for continuous supply of ink to ink cartridges in a printer. The ink supply system comprises a plurality of reservoir containers, a reservoir container mounting assembly, a plurality of ink tubes, a print carriage, and a plurality of ink cartridges. Specific embodiments are described herein with reference to the accompanying Figures, wherein like numerals refer to like elements throughout. For additional details regarding the nature and operation of inkjet printers having large volume ink reservoirs external to the ink cartridges, the reader is referred to U.S. Pat. No. 5,686,947 to Murray, et al., which is hereby incorporated in its entirety by reference thereto.

Figure 1B:
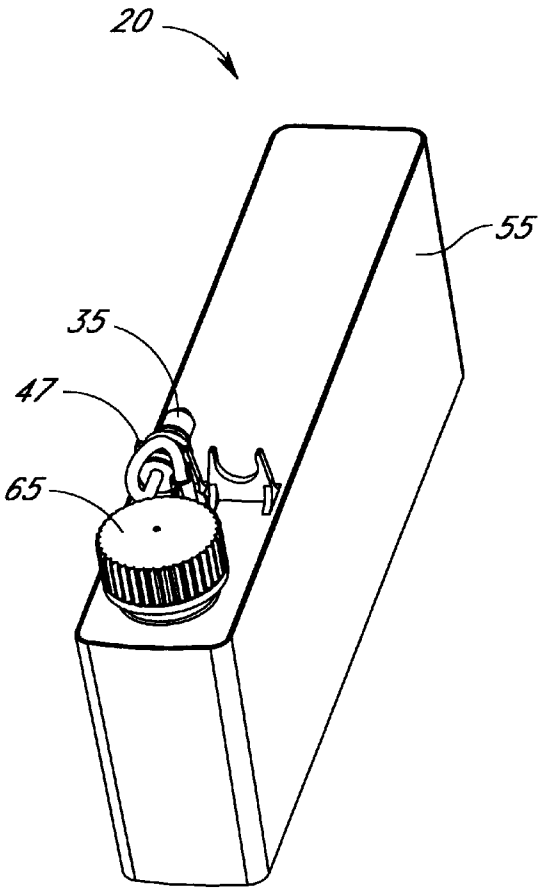
FIG. 1*b* is a perspective view of an ink reservoir having a second ink outlet configuration for use with a multi-plumbed ink jet printer.
Figure 1A:
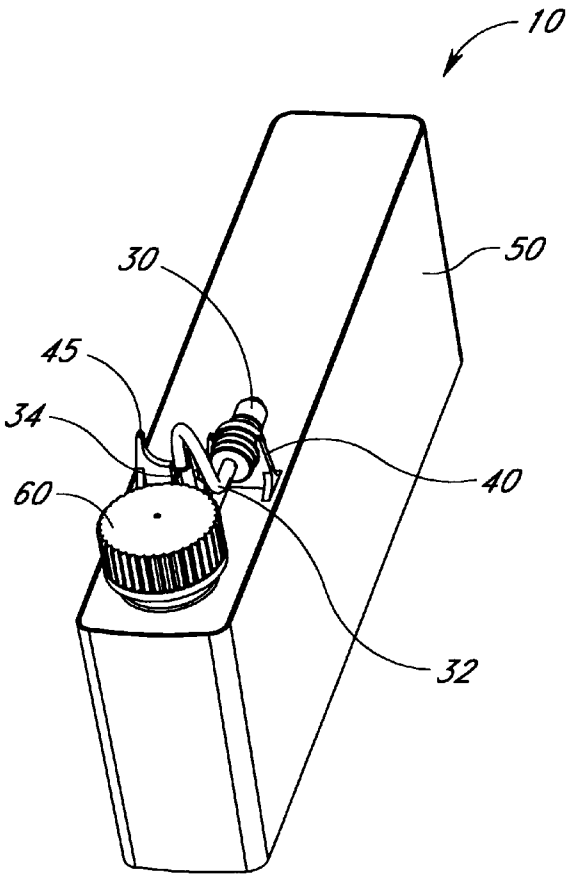
FIG. 1*a* is a perspective view of an ink reservoir having a first ink outlet configuration for use with a multi-plumbed ink jet printer.

FIGS. 1*a* and 1*b* illustrate two exemplary reservoir containers in accordance with the invention. As will be explained in detail below, the reservoirs illustrated in these Figures are adapted for use with a novel multi-plumbed ink jet printer illustrated in FIGS. 2 and 3. As shown in FIG. 1A, one type of reservoir container 10 in a double-plumbed configuration comprises a housing 50 for holding a large volume, typically about 200 milliliters to about 500 milliliters, of ink. An opening located on the top of the housing 50 is used for refilling or emptying the container 10. A vented cap 60 covers the container opening. The container 10 further includes a valved coupling insert 30 which is secured on a mounting flange 40 on the top of the housing 50. The valved coupling insert 30 is attached to one end of a short length of tubing 32. The opposite end of tubing 32 is connected to the first half of a quick disconnect fitting 34 which couples to a corresponding second half of a quick disconnect fitting provided in the top of the housing 50. The quick disconnect fitting 34 may comprises a twist-on leur lock type fitting well known to those of skill in the art. This second half of the quick disconnect fitting is coupled to a tube (not shown) which is inside the container 10. This tube extends down to the bottom of the container 10 and provides a fluid communication path between the ink in the housing 50 and the valved coupling insert 30.

Referring now to FIG. 1B, a modified container style is illustrated. In this case, a valved coupling insert 35 on the container 20 is secured in a left mounting flange 47. It can be appreciated that by incorporating two distinct positions for the valved coupling insert, the containers become effectively "keyed" for installation into an ink jet printer. Thus, by way of specific example, the respective containers 10 and 20 may be each filled with ink of the same color but of a specific composition for a different application. In some embodiments of the invention, one ink container 10 may hold ink especially adapted for making prints for indoor use and display whereas another container 20 may be filled with ink especially adapted for making prints for outdoor use and display. The keyed installation of reservoirs 10, 20 into an ink jet printer is illustrated in FIG. 2.

Figure 2:
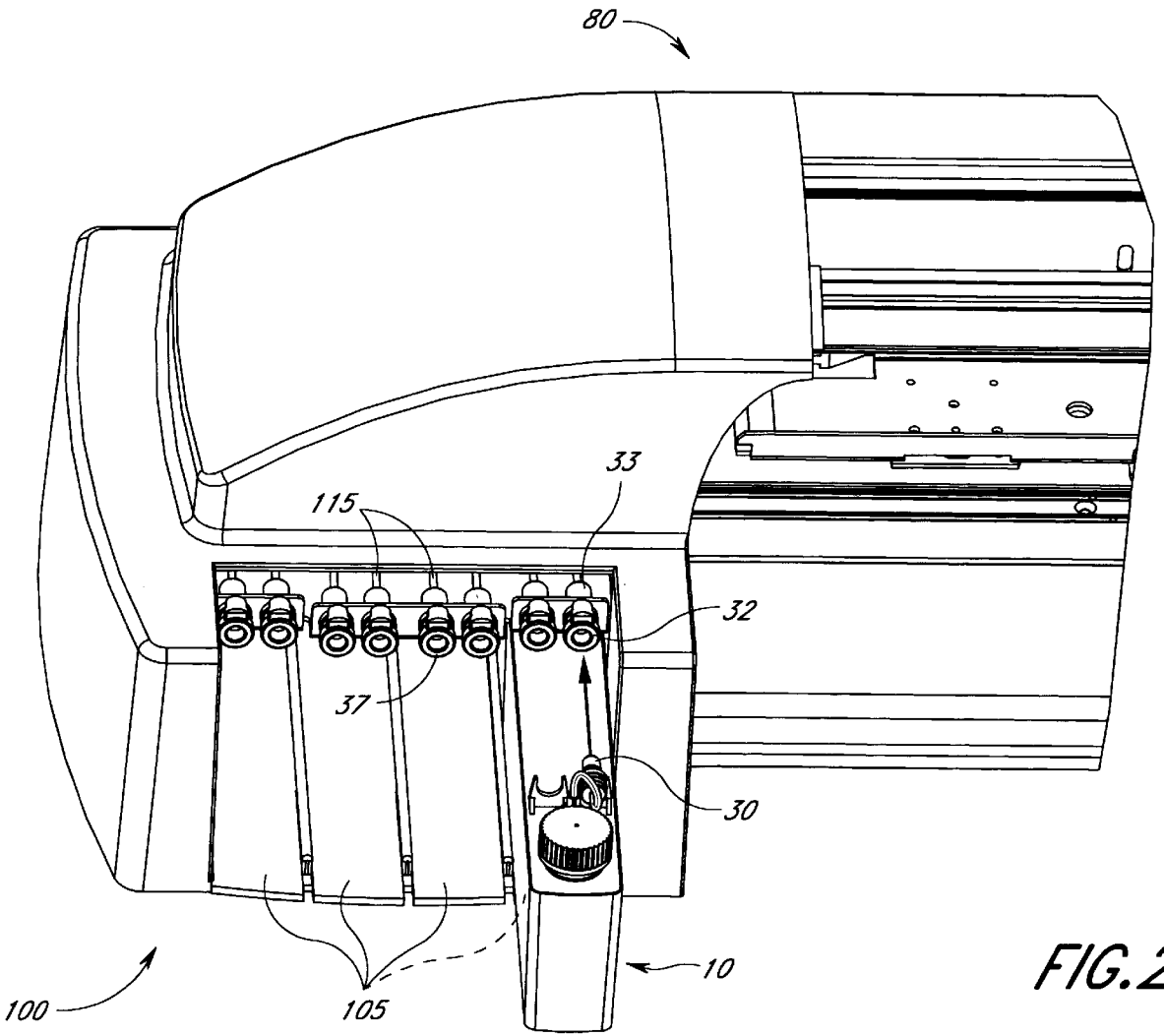
FIG. 2 is a perspective view of ink reservoir container mounting bays according to the invention on one end housing of an ink jet printer.

FIG. 2 illustrated the left sid of an ink jet printer 80, showing an ink reservoir mounting assembly 100 which is used for supporting one or more reservoir containers. As is illustrated in this Figure, the reservoir mounting assembly 100 may advantageously be made part of the left housing of the printer. The reservoir mounting assembly 100 is capable of mounting four containers for using the CMYK color set for producing color prints as well known to those of skill in the art. In other embodiments, the reservoir mounting assembly 100 is not limited to mounting four containers, but may be configured to accept a different number of containers depending on the desired application. In FIG. 2, for ease of illustration, only one large volume ink containers 10 is illustrated partially installed into one reservoir mounting bay 105. Three additional locations 105 for mounting large volume ink containers are illustrated without large volume containers 10 or 20 installed.

A feature of the embodiment illustrated in FIG. 2 is that both of the alternatively configured reservoir containers 10 and 20 may be installed in any of the four locations of the reservoir mounting assembly 100. Thus, the reservoir mounting assembly 100 provides four adjacent reservoir container mounting locations or bays 105. Each mounting bay 105 is provided with a right valved coupling body 32 and a left valved coupling body 37. As can be appreciated from an examination of FIG. 2, when a container 10 with a valved coupling insert 30 secured to the right mounting flange 40 slides into a mounting bay 105, the valved coupling insert 30 is engaged with the right valved coupling body 32. Analogously, when a container 20 with a valved coupling insert 35 secured to the left mounting flange 47 slides into a mounting bay 105, the valved coupling insert 35 is engaged with the left valved coupling body 37.

The valved coupling inserts 30 and 35 thus mate with the valved coupling bodies 32 and 37. In one embodiment, the valved coupling inserts 30 and 35 and valved coupling bodies 32 and 37 have internal flow valves which are opened upon mating. Accordingly, when a valved coupling insert 30 or 35 and a corresponding valved coupling body 32 or 37 are engaged, the ink is allowed to flow. Conversely, in one embodiment, when a valved coupling insert 30 or 35 or a valved coupling body 32 or 37 is not engaged, the internal flow valve in the valved coupling insert 30 or 35 or valved coupling body 32 or 37 is closed and the ink is not allowed to flow. As a result, a double shutoff condition occurs when a once mated valved coupling insert 30 or 35 and its corresponding valved coupling body 32 or 37 are disengaged. Snap-fit coupling inserts and snap-fit coupling bodies configured and valved in a manner described above and suitable for use with printers in accordance with the present invention are commercially available, from, for example, Colder Products Company of St. Paul Minn. For additional information concerning one possible embodiment for the internal structure of such valved couplers, the reader is referred to U.S. Pat. No. 5,494,074 to Ramacier, Jr. et al., the disclosure of which is hereby incorporated by reference in its entirety.

Ink may be withdrawn out of the containers 10 and 20 and into the printer when the containers 10 and 20 are installed in the mounting bays 105. When a container 10 or 20 is disengaged from its mounting bay, ink is prevented from flowing out of the removed container 10 or 20 and out of the removed container's corresponding ink cartridge in the printer because internal flow valves in the valved coupling inserts 30 and the valved coupling bodies 32 are automatically closed. Accordingly, when all the containers 10 and 20 are removed from the mounting bays 105, ink is prevented from flowing out of any of the containers 10 and 20 and out of the printer. As mentioned above, the coupling insert 30 or 35 and a corresponding coupling body 32 or 37 are advantageously configured for snap-in connection and automatic valve actuation.

A significant feature of the invention is that the installation of the containers 10 and 20 into the mounting bays 105 has been significantly simplified for the user. Connection involves the mere sliding of a container 10 or 20 into a bay 105, consequently engaging the coupling insert 30 or 35 into a corresponding coupling body 32 or 37. Disconnection involves simply pressing a thumb latch 33 located on each coupling body 32 or 37. This latch, when pressed, disengages a coupling insert 30 or 35 from its corresponding coupling body 32 or 37 allowing for their separation.

With the above described configuration, each of the right and left valved coupling bodies on the mounting assembly 100 is connected to a tube 115 to direct the flow of ink from the containers 10 and 20 and the valve coupling devices to the rest of the printer. As will be further described below with reference to FIG. 3, the tubes 115 are bundled inside a guide chain internal to the printer for routing to a moveable print carriage on the printer. The specific embodiment illustrated in FIG. 2 has eight tubes connected to the eight valved coupling bodies 32 or 37.

Figure 3:
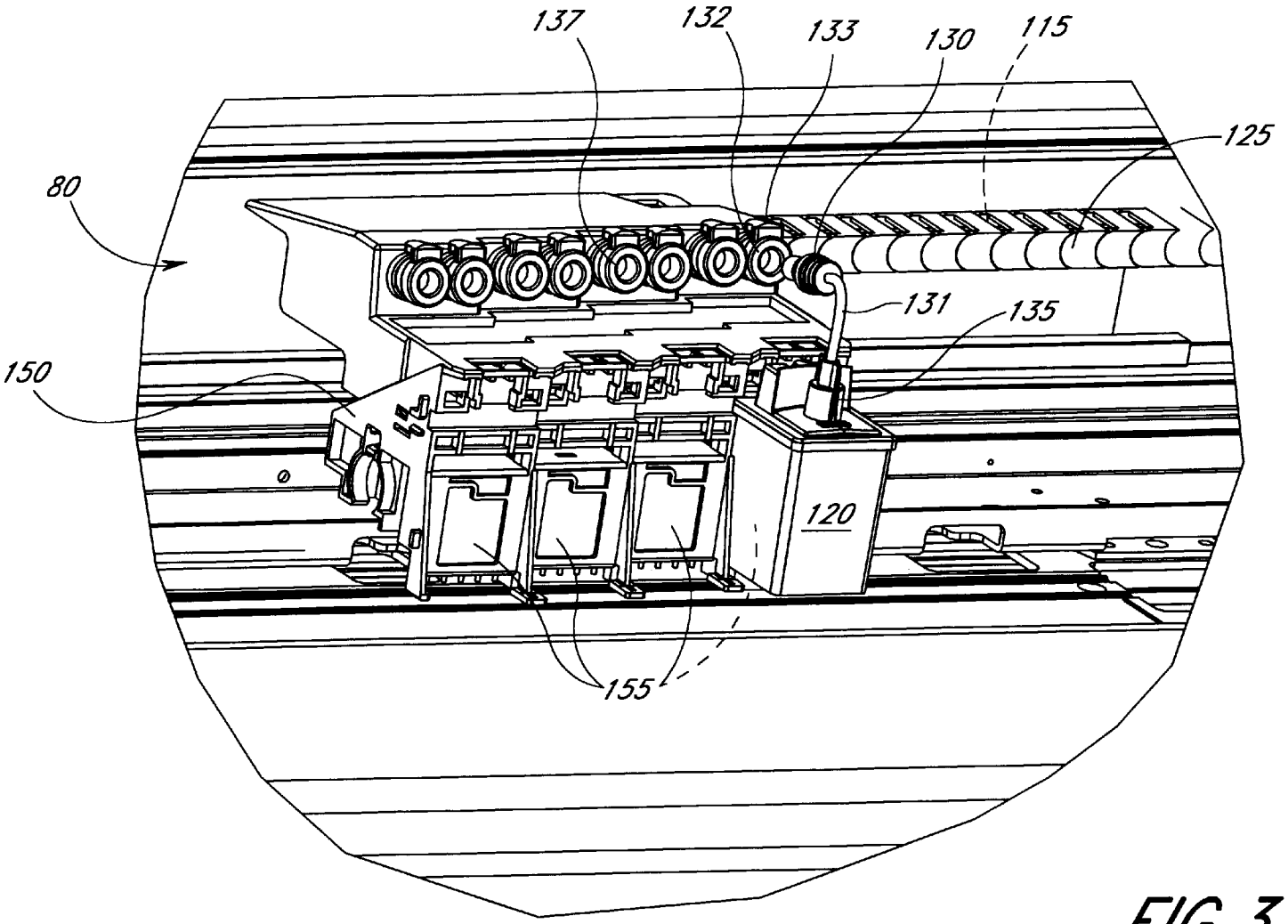
FIG. 3 is a perspective view of a multi-plumbed print carriage assembly for an ink jet printer.

FIG. 3 shows another portion of the printer 80, illustrating how the tubes 115 (of FIG. 2) are routed inside a plastic chain 125 to a movable print carriage 150 so as to supply ink to the cartridges of the printer. The plastic chain 125 maintains the tubes 115 in proper position as the print carriage 150 of the inkjet printer travels back and forth across a substrate.

As further shown in FIG. 3, the movable print carriage 150, similar to the reservoir mounting assembly 100, incorporates eight valved coupling bodies. These eight valved coupling bodies can be identical in configuration to the eight valved coupling bodies of the mounting bays. As can be appreciated with the examination of FIG. 3, a left valved coupling body 137 and a right valved coupling body 132 are associated with each one of four ink cartridge receiving locations 155 on the print carriage 150. The left and right valve coupling bodies 137 and 132 associated with a particular cartridge receiving location 155 are connected to two of the tubes 115 which are connected to corresponding left and right valved coupling bodies 37 and 32 associated with one of the mounting bays 105. Accordingly, a reservoir container 10 or 20 properly installed into a mounting bay 105 may be coupled to a corresponding ink cartridge 120 properly installed into a cartridge receiving location 155.

The ink cartridges 120, of which only one is shown in FIG. 3, advantageously include a valved coupling insert 130 attached to a short connecting tube 131. The short connecting tube is in turn attached to a first half of a quick disconnect fitting 135 which is coupled to a second half of the quick disconnect fitting 135 on the top of the ink cartridge 120. These may advantageously be configured as twist on luer-lock fitting as described above with respect to the quick disconnect fitting 34 on the ink container 10 of FIG. 1A. The quick disconnect fitting 135 may be coupled to a tube (not shown) which extends down into the ink of the ink cartridge 120. Siphon action is used to transport ink from a reservoir 10 or 20 to an ink cartridge 120 as ink is expelled during the printing operation. As was the case with the large volume ink reservoir containers 10 and 20, the valved coupling insert 130 on the cartridge 120 mates to a coupling body 132 or 137 via a snap-fit which automatically opens internal valves and enables ink flow. As before, connection is implemented merely by pushing the coupling insert 130 into the coupling body 132 or 137. Disconnection is achieved by pressing a thumb latch 133 and separating the coupling insert 130 from the coupling body 132 or 137.

With the above described multi-plumbed ink supply system, a user may easily switch between two different types of inks without cleaning or priming any connecting tubes 115. In one embodiment, a user keeps two sets of large volume ink containers as follows: one set with four reservoirs filled with outdoor ink and a second set with four reservoirs filled with indoor ink. In addition, two sets of four ink cartridges are kept as follows: one set for outdoor ink and one set for indoor ink. The two sets of large volume ink containers are identified by the mounting flange, the right 45 or the left 40, to which the coupling insert 30 or 35 is secured.

In one embodiment, indoor ink is kept in containers 10 having the coupling insert 30 secured to the right mounting flange 40. Outdoor ink is kept in containers 20 having the coupling insert 35 secured to the left mounting flange 45. In this case, the tubes connected between right side coupling bodies 32 and 132 are primed with indoor ink, and tubes connected between left side coupling bodies 37 and 137 are primed with outdoor ink. Thus, the right-sided coupling bodies allow ink flow for indoor printing applications, whereas the left-sided coupling bodies allow ink flow for outdoor printing applications.

For applications where it is desired to print with ink suitable for indoor use, the appropriate large volume ink reservoir container set is snapped into the mounting bays 105, connecting, in this example, ink to the right valved coupling bodies 32 in each bay 105. In addition, the appropriate cartridge set is chosen and each cartridge 120 is placed in the appropriate cartridge receiving location 155. Each coupling insert 130 on each cartridge 120 is connected to the right valved coupling body 132 associated with the respective cartridge receiving location 155.

For applications where it is desired to print with ink suitable for outdoor use, the large volume ink reservoir container set with outdoor ink is selected and slid into appropriate mounting bays 105. This time ink is connected to the left valved coupling bodies 37 in each bay 105. Then, the other cartridge set is chosen and each cartridge 120 is placed in the appropriate cartridge receiving location 155. Each coupling insert 130 on each cartridges 120 is connected to the left valved coupling body 137 associated with the respective cartridge receiving location 155.

Such a system and method are advantageous especially in printing applications where changing between ink types is typical. In one embodiment, the changing between ink types merely requires the snapping in and out of one set of large volume ink reservoir containers and ink cartridges for another set. No priming or cleaning is required.

In another alternative embodiment of the present invention, a multi-plumbed design of the reservoir containers and cartridges is advantageously used to print with more than four color planes. In one embodiment, twelve color plane printing is performed using color planes for each of three different optical densities of dye for each of the four CMYK colors. Each large volume ink reservoir container and ink cartridge comprises three separate chambers, each one dedicated to holding ink of a particular color at a particular optical density. In this case, instead of using only a single valved coupling insert on the large volume ink reservoir containers, the reservoir container is equipped with three valved coupling inserts, one for each chamber. Each of the three valved coupling inserts of each reservoir container is in fluid communication with a different ink chamber within the reservoir container.

A large volume cyan reservoir container includes, in this embodiment, three chambers: a chamber with full strength cyan ink, a chamber with cyan ink having 50% of the optical density of the full strength cyan ink, and a chamber with cyan ink having 25% of the optical density of the full strength cyan ink. Each chamber connects in a purely one-to-one mapping with one of the three valved coupling inserts in a given reservoir container. In this alternative embodiment, each mounting bay 105 also includes three valved coupling bodies which simultaneously mate with the three valved coupling inserts when a reservoir container is slid into position in a mounting bay 105.

Furthermore, in this alternative embodiment, each cartridge 120 also includes three separate chambers, each with a dedicated set of ink ejection orifices, for separately holding and expelling the three different optical densities of a particular color. Accordingly, each cartridge receiving location 155 on the print carriage 150 includes a set of three valved coupling bodies which supply ink from the chambers of the large volume ink reservoir containers to the appropriate chambers of each cartridge. This system advantageously allows twelve color plane printing without the need to include twelve large volume ink reservoir containers or twelve separate ink cartridges.

Figure 4:
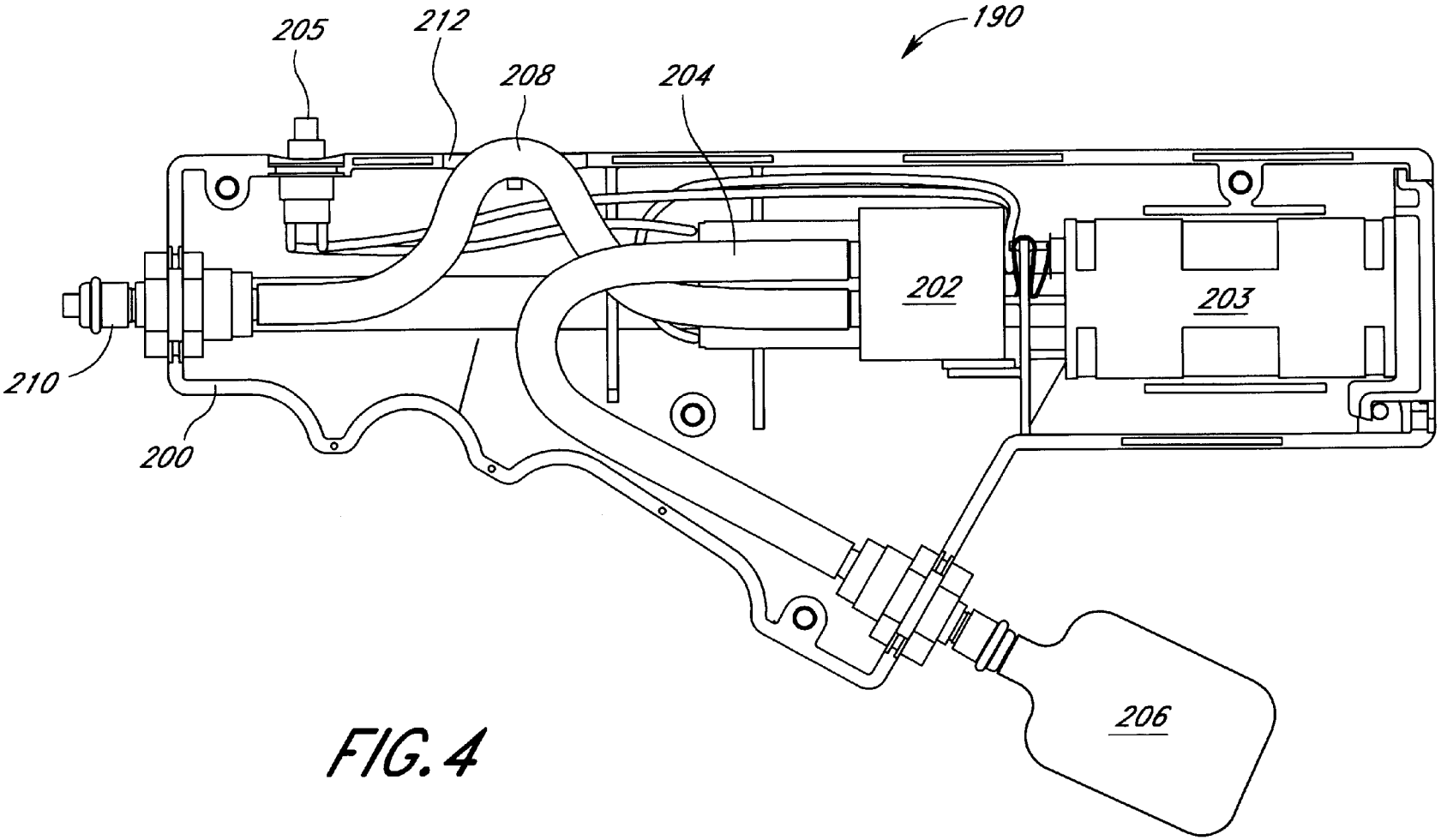
FIG. 4 is a cross section of a handheld priming system.

FIG. 4 illustrates yet another aspect of the present invention. In FIG. 4, a priming device 190 is shown in cross section. The priming device 190 preferably includes a housing 200 which is advantageously shaped to be comfortably held in one hand by the user. Inside the housing 200 is a pump 202 which may be a diaphragm, peristaltic, or another pump type suitable for both wet and dry operation. The pump 202 may be powered by an internal battery pack 203, and may be actuated by a switch 205 which may be positioned so as to be convenient for actuation by a user's thumb when holding the housing. The pump 202 has an input 208 which is connected to a valved coupling insert 210 of a configuration identical to the valved coupling inserts 130 attached to the ink cartridges. With this insert 210, priming of the tube running from the large volume reservoirs to the print carriage may be performed as set forth below. In some advantageous embodiments, the input 208 is routed adjacent to an opening 212 in the housing 200 so that the user may verify that ink has been sucessfully pulled through the system and into the priming device 190 during a priming operation. The pump output 204 is routed to a vented waste bottle 206 attached to the housing 200. The connection between the priming device 190 and the waste bottle 206 may advantageously comprise an engaged valved coupling insert and valved coupling body.

Figure 5:
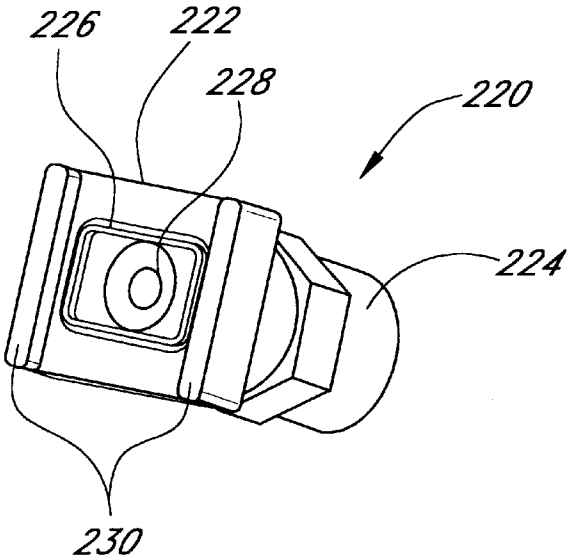
FIG. 5 is a perspective view of a fitting for use with the priming system of FIG. 4.

To conveniently perform a priming operation, the valved coupling insert 210 is advantageously coupled to an adapter 220 illustrated in FIG. 5. The adapter 220 comprises suction cup tip 222 made of compliant material which is connected to a valved coupling body 224. This valved coupling body may be identical to the valved coupling bodies 132, 137 on the print carriage so as to engage with the valved coupling insert 210 on the priming device 190. In one embodiment, the tip 222 is made from a soft rubber, and includes a lipped aperture 226 which is sized to fit around the jet plate of an ink jet cartridge.

Figure 6:
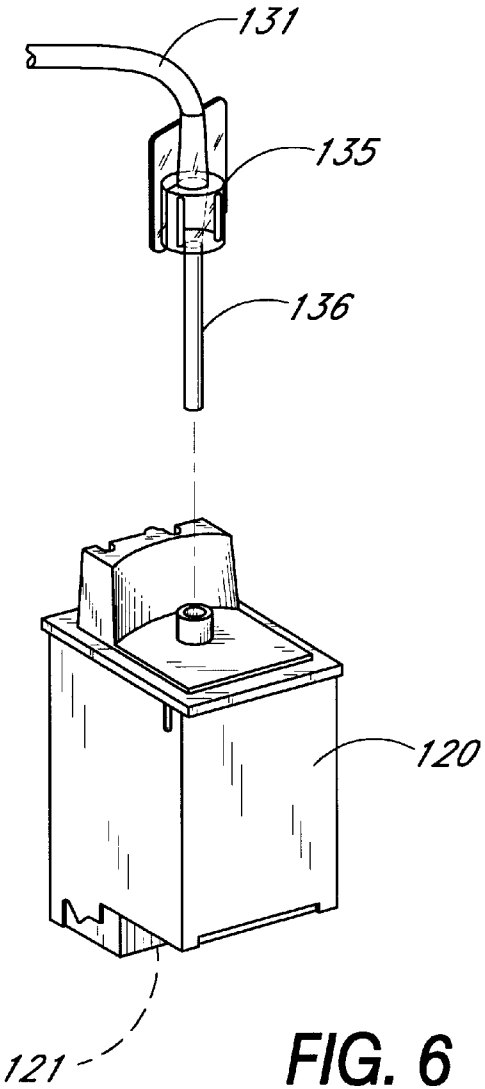
FIG. 6 is a perspective view of a cartridge as also illustrated in FIG. 3, illustrating the connecting tube for supplying ink to the jet plate of the cartridge.

Refering now to FIG. 6 as well as FIG. 5, replacement of an ink jet cartridge involves releasing the luer-lock fitting 135 attached to the cartridge, and pulling the connecting tube 136 out of the cartridge to be replaced. The connecting tube 136 is then placed into the replacement cartridge 120. To prime the replacement jet plate 121 on the bottom of the cartridge 120, the adapter 220 is placed onto the valved coupling insert 210 on the priming device 190, and the aperture 226 is placed over the jet plate 121. Ridges 230 may be provided on the sides of the rubber tip to fit around the bottom of the cartridge 120 to assist in laterally positioning the aperture 226 over the jet plate 121. The pump 202 is then actuated, and ink is sucked through the ink jet orifices of the jet plate, thereby priming the cartridge.

During usual cartridge replacements, the tubing 115 is already primed. However, if new ink is needed in the system, or if the ink has been drained for shipping the printer or some other reason, the tubing 115 may need to be refilled with ink. The priming device 190 and adapter 220 illustrated in FIGS. 4 and 5 may also be used to prime the tubing 115 in these circumstances. For this operation, the adapter 220 additionally includes a recessed central circular aperture 228 which is sized to fit snugly over the connecting tube 136 which feeds ink to the jet plate. To prime one of the ink supply tubes 115, the desired connecting tube is inserted into the central aperture 228, and the pump 202 is actuated, drawing ink through the tubing 115. It will be appreciated that this procedure may also be used to flush the tubing 115 by filling a large volume reservoir 50, 55 with water, and priming as described. Priming and/or flushing is thus accomplished in a convenient and clean manner. Although the embodiment illustrated in FIG. 4 is a separate handheld unit, it may be appreciated that the priming device 190 may alternatively be housed within the printer itself.

The foregoing description details certain preferred embodiments of the present invention and describes the best mode contemplated. It will be appreciated, however, that no matter how detailed the foregoing appears in text, the invention can be practiced in many ways. It should be noted that the use of particular terminology when describing certain features or aspects of the present invention should not be taken to imply that the broadest reasonable meaning of such terminology is not intended, or that the terminology is being re-defined herein to be restricted to including any specific characteristics of the features or aspects of the invention with which that terminology is associated. The scope of the present invention should therefore be construed in accordance with the appended claims and any equivalents thereof.

What is claimed is:

1. A multi-plumbed inkjet printer comprising:

a container mounting assembly with a plurality of bays, a plurality of quick disconnect fittings separately associated with each bay such that each bay mounts more than one quick disconnect fitting, said quick disconnect fittings having a predetermined spatial relationship relative to one another within each bay;

a set of containers removably mounted on said bays, each container having an ink reservoir; and a quick disconnect fitting located at a specified position on each container, wherein the position of said quick disconnect fitting on said container is indicative of a characteristic of ink in said ink reservoir, and wherein the position of the quick disconnect fitting on the container is aligned with one of the quick disconnect fittings of the bay such that when said container is removably mounted on said bay, the quick disconnect fitting of the container connects with one of the quick disconnect fittings of the bay.

2. A printer comprising:

a moveable print carriage having at least one ink jet cartridge mounting bay, wherein said ink jet cartridge mounting bay is configured to hold a single individual ink jet cartridge;

a stationary mounting bay for an ink reservoir container having at least one ink reservoir, wherein said stationary mounting bay is configured to hold a single individual ink reservoir container; and a plurality of ink supply tubes connected at a first end to said stationary mounting bay and at a second end to said ink jet cartridge mounting bay.

3. The printer of claim 2 wherein at least one of said plurality of ink supply tubes comprises a valved coupling body connected to said first end and a valved coupling body connected to said second end.

4. An ink reservoir container in a printer comprising:

a housing;

at least one chamber inside said housing;

a first tubing section inside said chamber;

a first half of a first quick disconnect coupling on said housing, said first half of said first quick disconnect coupling connected to said first tubing section; and a quick disconnect coupling assembly attached to said quick disconnect coupling on said housing.

5. The ink reservoir container of claim 4, wherein said quick disconnect coupling assembly comprises:

a second half of said first quick disconnect coupling connected with said first half of said first quick disconnect coupling;

a second tubing section attached to said second half of said first quick disconnect coupling; and a first half of a second quick disconnect coupling connected to said tubing section.

6. An ink reservoir container for an ink jet printer comprising;

an ink outlet;

a first mounting location for said ink outlet; and a second mounting location for said ink outlet placed in a predefined location with respect to said first mounting location, whereby said ink outlet may alternatively be positioned on said housing at either said first mounting location or said second mounting location thereby allowing keyed container installation into said ink jet printer.

7. The ink reservoir container of claim 6, wherein said first and second mounting locations comprise first and second mounting flanges.

8. An ink jet printer comprising:

a moveable print carriage having a number of ink jet cartridge receiving locations;

a plurality of ink supply tubes routed to said moveable print carriage, wherein said plurality of ink supply tubes routed to said moveable print carriage is greater than said number of said ink jet cartridge receiving locations.

9. The ink jet printer of claim 8 wherein said number of ink jet cartridge receiving locations comprises four ink jet cartridges receiving locations and wherein said plurality of ink supply tubes comprises eight ink supply tubes.

10. The ink jet printer of claim 8 wherein said number of ink jet cartridge receiving locations comprises four ink jet cartridges receiving locations and wherein said plurality of ink supply tubes comprises twelve ink supply tubes.

* * * * *